United States Patent [19]

McKendrick et al.

[11] 4,277,960

[45] Jul. 14, 1981

[54] SYNCHRONIZATION OF MULTIPLE STREAM LIQUID APPLICATION PROCESSES

[75] Inventors: George A. R. McKendrick, Port Vila; Ian G. Bartlett, Belmont; Donald A. Lymer, Highton, both of Australia

[73] Assignee: Tybar Engineering Pty. Ltd., Victoria, Australia

[21] Appl. No.: 113,669

[22] Filed: Jan. 21, 1980

[30] Foreign Application Priority Data

Jan. 24, 1979 [AU] Australia ..... PD7458

[51] Int. Cl.[3] ..... D06B 1/02; D06B 11/00; D06B 23/10

[52] U.S. Cl. ..... 68/205 R; 118/691; 118/712

[58] Field of Search ..... 68/205 R; 118/712, 713, 118/714, 688, 689, 690, 691, 697, 698, 704

[56] References Cited

U.S. PATENT DOCUMENTS 4,097,946 7/1978 McCollough ..... 68/205 R X 4,111,012 9/1978 O'Neill, Jr. ..... 68/205 R 4,170,883 10/1979 Varner ..... 68/205 R

*Primary Examiner*—Philip R. Coe

*Attorney, Agent, or Firm*—O'Brien and Marks

[57] ABSTRACT

A program controlled multiple stream liquid application process in which longitudinal asynchronism between the application of the portions of liquid is reduced by intermittently or continuously detecting the emission of a test stream at each liquid application station, generating, in response to said detection, an electrical signal indicating the time of emission of each test stream with one or more reference times and thereby to generate a correction signal indicative of the extent of longitudinal asynchronism, and modifying the program control in response to the correction signal. A complementary apparatus is also disclosed. In a separate aspect, multiple stream liquid application apparatus includes means coupling the conveyor and the liquid applicator means so that lateral displacement of the conveyor induces a corresponding displacement of the liquid applicator means.

5 Claims, 4 Drawing Figures

SYNCHRONIZATION OF MULTIPLE STREAM LIQUID APPLICATION PROCESSES

FIELD OF THE INVENTION

This application relates broadly to processes of the kind in which one or more portions of a liquid such as liquid dye are successively applied to a lengthwise moving strip in one or more respective sets of multiple streams at liquid application stations spaced apart along the strip in its direction of travel. The strip may be continuous or discontinuous.

BACKGROUND OF THE INVENTION

Processes of this kind have been found to be especially suited to the dyeing of travelling carpet webs and are so exemplified in U.S. Pat. Nos. 2,218,811, 3,393,411, and 4,033,154, in United Kingdom Pat. No. 1,202,345, and in the present applicant's co-pending patent application Ser. No. 042,501. In these prior arrangements, each dye application station comprises a multiplicity of individual nozzles each giving rise to a discrete stream directed towards the passing carpet. The streams are typically computer controlled so that the portions of dye applied by the succession of stations are complementary and thereby give rise to a predetermined pattern. It will be appreciated that an accurately resolved pattern will be obtained, and maintained, only if there is a precise and on-going synchronism between the carpet movement and the dye applications. Synchronization is required longitudinally between the respective dye applications and laterally between the positions of the carpet and the nozzles at each application station.

Approximate longitudinal synchronism is achieved by clocking pattern application with respect to carpet speed and thereby retarding dye application at each station relative to dye applications at each preceding station to match the time taken for a carpet increment to travel between the stations. However, it is found that the precise delay time is dependent not solely upon carpet speed but more finely upon the relative dye pressures at the application stations, which in turn are determined, inter alia, by dye viscosity and by the proportion of nozzles simultaneously applying dye. At the commencement of a print run, these variables will be determined by the actual dye chosen, by atmospheric conditions and by the nature of the pattern to be produced.

At present, fine synchronization to correct for dye pressure variations is carried out by manual adjustment of the retard time for each station on the basis of experienced operator observation, which is time consuming and entails not insignificant carpet wastage, especially where pattern changeover is carried out with continuously moving carpet. Moreover, on a longer run, fine asynchronism may arise when, for example, ambient temperature changes affect dye pressures differently.

SUMMARY OF THE INVENTION

It is an object of the invention to provide an improved method and apparatus for achieving, and if necessary maintaining, longitudinal synchronism of the successive liquid applications in multiple stream liquid application processes.

The invention accordingly provides a process for applying a liquid such as liquid dye to a moving strip wherein two or more portions of liquid are successively applied in respective sets of multiple streams at liquid application stations spaced apart along the strip in its direction of travel, which multiple streams are selectively controlled by programmable electronic control whereby said portions once applied are complementary so as to give rise to a pattern on the strip, wherein longitudinal asynchronism between the application of the portions of liquid is reduced by intermittently or continuously detecting the emission of a test stream of liquid at each station, generating, in response to said detection, an electrical signal indicating the time of emission of each test stream with one or more reference times and thereby to generate a correction signal indicative of the extend of said longitudinal asynchronism, and modifying said selective control of the multiple streams in response to said correction signal whereby to reduce said asynchronism.

Said reference times, may be a base time and/or may include the time of emission of another of said test streams and/or may include the pattern base time for the first liquid application.

The invention also provides apparatus for applying liquid such as a liquid dye to a moving strip comprising:

a plurality of spaced liquid application stations each including an array of multiple openings arranged above and transversely of the conveyor means;

conveyor means for carrying a strip successively past said liquid application stations;

means including a programmable electronic control for selectively controlling the successive application of portions of liquid to the strip in respective sets of multiple streams at the liquid application stations, whereby said portions once applied are complementary so as to give rise to a pattern on the strip;

means at each dye application station for emitting a respective test stream of liquid for the station;

means for detecting each test stream and generating in response thereto an electrical signal indicating the time of its emission;

means for receiving said signals and comparing the time of emission of each test stream with one or more reference times thereby to generate a correction signal indicative of the extent of said longitudinal asynchronism; and means coupled to or forming part of said electronic control for modifying said selective control of the multiple streams in response to said correction signal whereby to reduce said asynchronism.

The detecting means may comprise photo-responsive devices arranged to be triggered by passage of a respective one of the test streams. The test stream may be a liquid droplet and the steps of the inventive process may be repeated with test emission of each droplet of a controlled series of droplets. In this way, ongoing monitoring for asynchronism can be carried out.

Preferably, said means for emitting the test streams comprises respective dedicated test nozzles associated with the dye application stations. These test nozzles may be spaced from the associated liquid application stations at a known position but are preferably themselves spaced by distances similar to the separations of the stations. Advantageously, the respective detecting means are at a common distance below the test nozzles, preferably at positions corresponding to that of the moving strip.

The comparison and modifying means may form part of said programmable electronic control, which control is connected to continuously receive signals from the various detection means and, on a substantially continuous basis, to effect the aforementioned comparisons and modifications as part of its program controlled task. The reference data for determining requisite adjustments on the basis of the comparisons may be supplied to the control either as part of the program or alternatively, by way of adjustable-input hardware components.

Whereas longitudinal synchronization involves adjustment of time delay factors with a view to balancing variations in physical parameters, lateral synchronization calls for a somewhat different approach. In this case, the difficulty is simply one of minimizing or compensating for slight displacement of each bank of nozzles relative to the underlying strip such as carpet web. It is found in practice that lateral displacement of the carpet on its conveyor does not occur to any appreciable extent and thus it is believed that the primary source of pattern asynchronism in the lateral direction is slight movement of the conveyor relative to the nozzles.

The invention also provides apparatus for applying liquid to a moving strip comprising:

A conveyor for guiding a strip past a liquid application station;

liquid applicator means at the station extending laterally of the conveyor for applying liquid in multiple streams to a strip carried thereby which applicator means is moveable laterally of the conveyor; and means coupling the conveyor and the liquid applicator means whereby lateral displacement of the conveyor induces a corresponding displacement of the liquid applicator means.

The coupling means may include the follower block slidably engaging a lateral margin of the conveyor. Preferably, the follower block is biased against said margin by an adjustably spring-loaded centering device.

BRIEF DESCRIPTION OF THE DRAWINGS

The invention will be further described, by way of example only, with reference to the accompanying drawings, in which.

DESCRIPTION OF THE PREFERRED EMBODIMENTS

Figure 1:
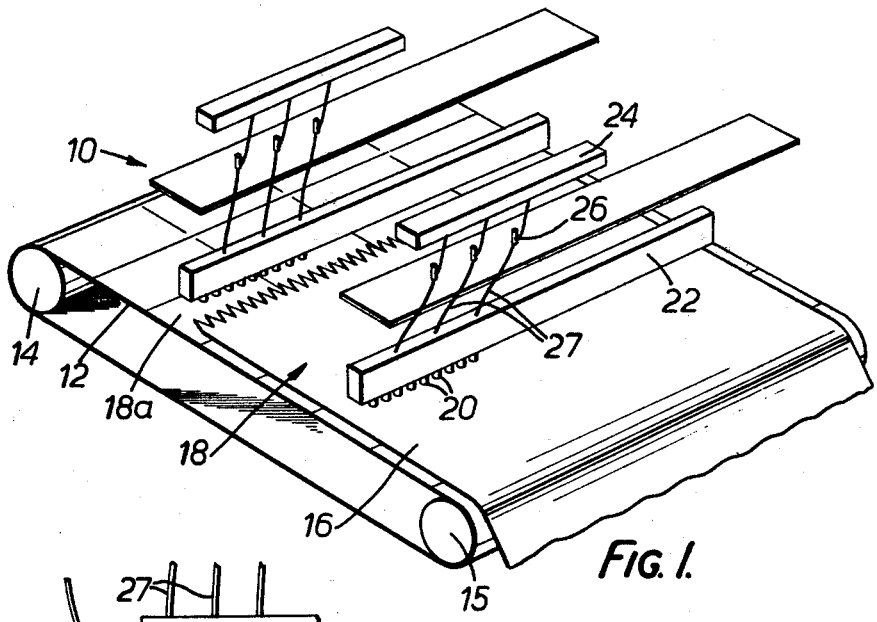
FIG. 1 is a schematic view of carpet dyeing apparatus to which the present invention is applicable.

The apparatus 10 represented schematically in FIG. 1 comprises a conveyor in a form of a wire mesh belt 12 supported on spaced rollers, two of which are shown at 14, 15, and on longitudinally extending runners (not shown). One of the rollers is driven (by means not shown) so that a strip of carpet 16 may be carried longitudinally past a succession of dye application stations. In this instance, for purposes of clarity, only two stations 18, 18*a* are illustrated but typically there might be of the order of six stations.

Each of the dye application stations, 18, 18*a* includes an array of nozzles 20 extending transversely of and above the conveyor. These nozzles are supported in a nozzle board 22 and are supplied with dye liquor from a manifold 24 by way of respective solenoid flow valves 26 and flexible tubes 27. A master control 28 (FIG. 3) includes valve control circuitry 28*a* programmable to open and close the control valves to thereby selectively control multiple streams issuing from the nozzles 20 in accord with the pattern desired to be produced on the travelling carpet.

In a modification in accord with applicant's copending application Ser. No. 042,501, rather than providing an individual valve for each nozzle 20, each valve supplies a distributor connected to several nozzles in a respective group of nozzles, the arrangement being such that one or more repeats of the pattern occur across the carpet. In this case, the lengths of the fluid lines which connect the nozzles of each group to its distributor are substantially equal. It should also be appreciated that while direct valve control of the liquid stream is implied in FIG. 1, control may be indirect, such as by way of valved control of a deflection fluid jet for each issuing liquid stream.

Each dye application station applies dye liquor of a particular chosen colour and the portions of dye deposited at the respective dye application stations are intended once supplied to be complementary so as to give rise to a chosen pattern on the strip of carpet. It will be appreciated that for a given longitudinal increment of the carpet, dye application to that increment by stations downstream of the first must be retarded in time with respect to application of dye to the increment by the first station, which time allows the increment to travel from one station to the next. For this reason, appropriate retard times are built in to the pattern program and the transmission of pattern data to control switches for the valves is clocked with respect to the travel of the conveyor belt 12. However, for each particular print run, differing dye pressures, in turn determined by, inter alia, dye viscosities and the proportion of nozzles simultaneously applying dye may affect the accuracy of the retard times provided for, and pattern resolution may thereby be adversely affected.

Figure 2:
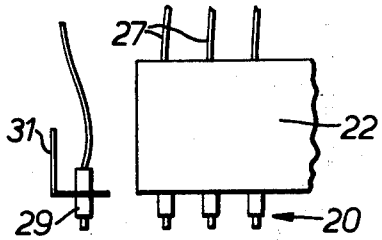
FIG. 2 is an elevational schematic enlargement of part of a nozzle board depicting a test nozzle and associated detector.
Figure 3:
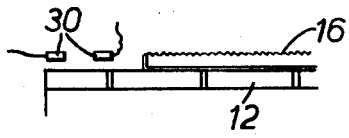
FIG. 3 is a simplified block circuit diagram indicating how longitudinal synchronism is obtained, and maintained, in use of the apparatus of FIG. 1 incorporating the features shown in FIG. 2.
Figure 3:
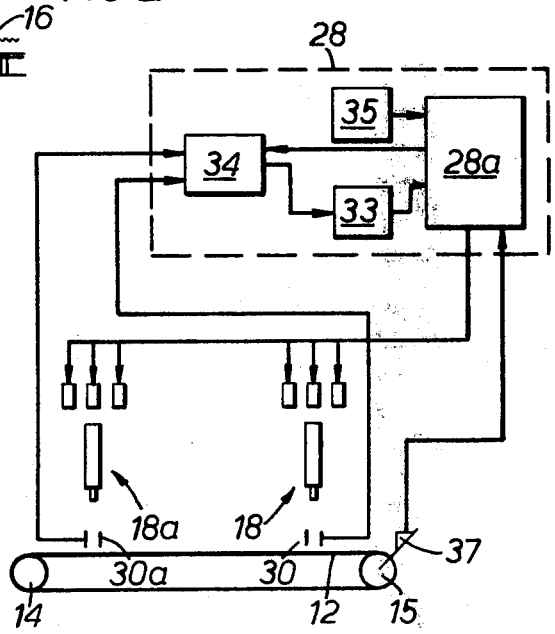

To assist in correcting for this fine longitudinal asynchronism on commencement of a print run, and then maintaining synchronism as the run proceeds, the apparatus of FIG. 1 is modified as shown in FIGS. 2 and 3. A dedicated test nozzle 29, 29*a* for each station is mounted on a bracket 31, 31*a* laterally of the respective nozzle boards and the master control is provided with a mode 35 by which the test nozzles of the successive dye application stations may be caused to emit test streams of dye liquor, comprising a regular succession of droplets. The test nozzles 29, 29*a* are typically arranged outside the lateral margins of the carpet but this is not strictly necessary. Disposed below each test nozzle is a two-part detector 30, 30*a* which is photosensitive to the passage of the front of a test stream, which may be a single droplet from the nozzle. Preferably, these detectors are uniformly displaced, preferably between 6 and 100 mm, below the nozzles, and are positioned at approximately the level of the carpet, with the test nozzles at the same height as the print nozzles 20.

Once master control 28 is operative in the test mode, dye is emitted from the two test nozzles as a sequence of droplets and the fronts of the successive droplets are detected by detectors 30, 30*a*. Output signals generated by the detectors, which signals indicate the times of emission of the respective test streams or droplets are fed back to the control, specifically to comparators 34 forming part of the control. One of two comparisons may be made: either the time between the detection of the test streams at detectors 30, 30*a* is compared with a nominal time or the time elapsed before each detection is individually compared with a respective nominal time, such nominal times being supplied by the program by way of valve control circuitry 28*a* and assuming no dye pressure variations. The time unit is of course dependent on conveyor movement, as sensed by a transducer 37 associated with the conveyor.

Output correction signals generated by comparators 34, such signals being indicative of the extent of longitudinal asynchronism, pass to adjustment circuitry 33 for modifying the selective control of the multiple dye streams issued at nozzles 20 whereby to reduce the asynchronism. This is essentially achieved by adjusting programmed retard times applied to the valve control circuitry. The process is carried out until longitudinal synchronism is obtained at the commencement of a print run and is then automatically continued during the run to ensure minimization of asynchronism. Such may arise, for example, in a longer print run as temperature changes affect dye viscosities to varying extents. In practice, a test stream in the form of a discrete droplet is emitted at the rate of between 3 and 6 per repeat of the pattern, perhaps every 15cms of carpet travel.

An important advantage of the invention is the elimination of visually based manual synchronization. Even for a skilled operator, this is a time consuming operation. Where it is desired to changeover pattern without stopping carpet movement, the invention minimises the time taken and therefore the wastage of carpet.

Figure 4:
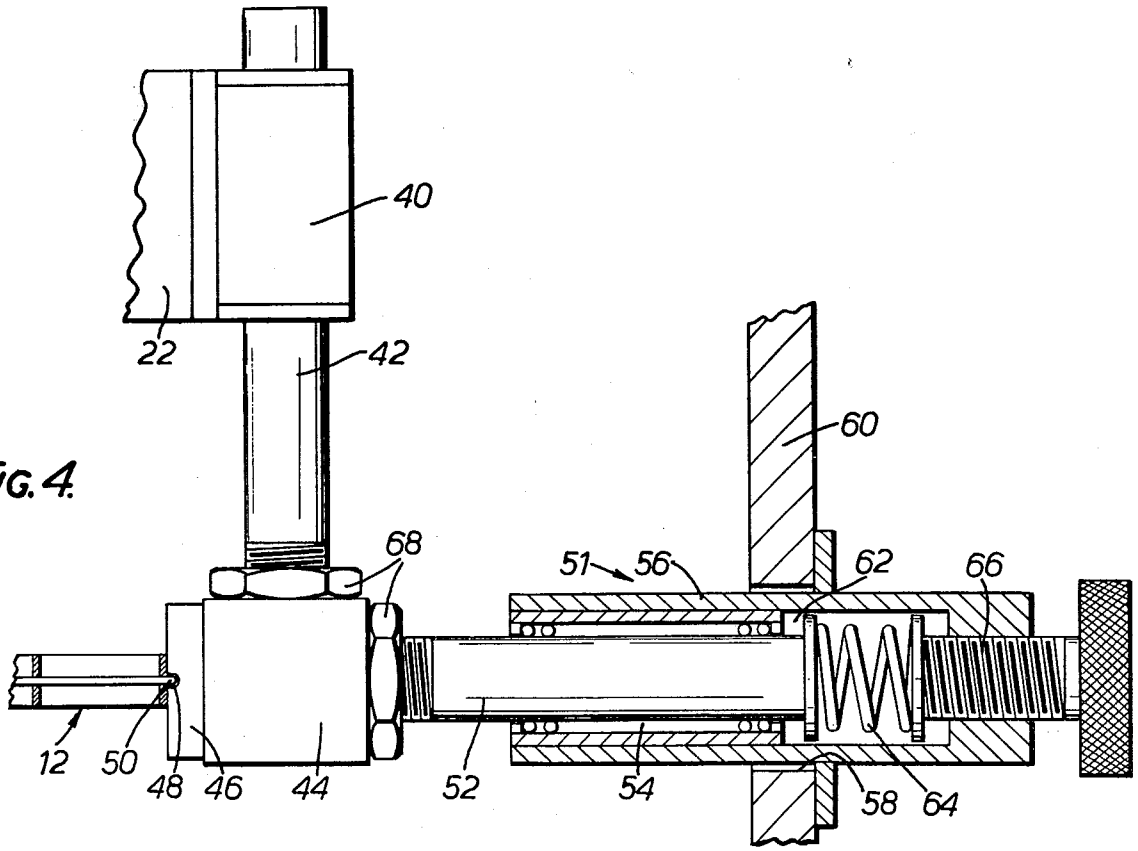
FIG. 4 is a partially sectioned elevation of one end of a liquid application station depicting the preferred arrangement for minimising lateral asynchronism.

FIG. 4 shows a further modification of the apparatus of FIG. 1 by which one end of each nozzle board 22 is coupled to the conveyor belt 12 so as to largely alleviate lateral asynchronism between the respective components. The drawing shows ony one end of one nozzle board but is representative of similar arrangements found at one end of each of the nozzle boards of the other dye application stations.

As shown, nozzle board 22 carries at its end a ball bushing 40 for slidably mounting the board to an upright shaft 42. Bushing 40 is necessary because the nozzle board is nominally vertically adjustable between its print and neutral modes, as detailed in applicants copending patent application Ser. No. 042,501. Shaft 42 is screw threadingly engaged at its lower end with a follower block 44 which in turn carries on its inside face a wear strip 46 of a material such a polyethylene. Block 44 extends about 30cm along the margin of the conveyor. Wear strip 46 is slotted at 48 to slidably receive a protruding marginal formation 50 on the conveyor belt. Block 46 is biased against the margin of the belt by a second, adjustably spring loaded centering device 51. Device 51 includes a shaft 52 which is also screw threadingly engaged with the follower block and is slidable by way of a ball bushing 54 within a sleeved housing 56 fastened in aperture 58 in a side plate 60 of the machine frame. A head 62 on the outer end of shaft 52 within housing 56 engages a helical compression spring 64, the tension of which is adjustable by rotation of a screw 66 threadingly displaceable through the outer end wall of housing 56.

It will be noted that the two shafts 42, 52 carry nuts 68 for adjustably setting their positions relative to the follower block.

It will be appreciated that the coupling arrangement just described, will serve to provide edge guiding for centering the conveyor belt to accurately transmit to the nozzle board any lateral conveyor belt movement which does occur. Specifically, it will be seen that lateral displacement of the conveyor belt induces, through follower block 46 and upright coupling shaft 42 a corresponding lateral displacement of the nozzle board 22. To permit this displacement, the nozzle board is preferably coupled to its vertical displacement system by way of one or more, typically two, sliding bearings (not shown).

We claim:

1. Apparatus for applying liquid such as a liquid dye to a moving strip comprising:

conveyor means for carrying a strip past liquid applications stations;

a plurality of spaced liquid application stations each including an array of multiple openings arranged above and transversely of the conveyor means;

means including a programmable electronic control for selectively controlling the successive application of portions of liquid to the strip in respective sets of multiple streams at the liquid application stations, whereby said portions once applied are complementary so as to give rise to a pattern on the strip;

means at each dye application station for emitting a respective test stream of liquid for the station;

means for detecting each test stream and generating in response thereto an electrical signal indicating the time of its emission;

means for receiving said signals and comparing the time of emission of each test stream with one or more reference times thereby to generate a correction signal indicative of the extent of longitudinal asynchronism; and means to be coupled to or forming part of said electronic control for modifying said selective control of the multiple streams in response to said correction signal whereby to reduce said asynchronism.

2. Apparatus according to claim 1 wherein said test stream emitting means comprise respective dedicated test nozzles associated with the dye application stations.

3. Apparatus according to claim 2 wherein the test nozzles are mounted separately from nozzles defining said multiple openings of the dye application stations.

4. Apparatus according to claim 2 or 3 wherein the detecting means are disposed at a uniform distance below the respective test nozzles.

5. Apparatus according to claim 1 or 2 wherein said comparison and modifying means form part of said programmable electronic control, which control is connected to continuously receive signals from the various detection means, and on a substantially continuous basis, to effect the said comparisons and modifications as part of its program controlled task.

* * * * *